US011505845B2

(12) United States Patent
Kim et al.

(10) Patent No.: US 11,505,845 B2
(45) Date of Patent: Nov. 22, 2022

(54) SOFT HIGH-SILICON STEEL SHEET AND MANUFACTURING METHOD THEREOF

(71) Applicant: POSCO, Pohang-si (KR)

(72) Inventors: Dong-Kyun Kim, Pohang-si (KR); Byung-Deug Hong, Pohang-si (KR); Seok-Hwan Choi, Pohang-si (KR)

(73) Assignee: POSCO, Pohang-si (KR)

( * ) Notice: Subject to any disclaimer, the term of this patent is extended or adjusted under 35 U.S.C. 154(b) by 580 days.

(21) Appl. No.: 16/565,759

(22) Filed: Sep. 10, 2019

(65) Prior Publication Data

US 2020/0048729 A1 Feb. 13, 2020

Related U.S. Application Data

(62) Division of application No. 15/107,810, filed as application No. PCT/KR2013/012147 on Dec. 24, 2013, now abandoned.

(51) Int. Cl.

| | |
|---|---|
| ***C21D 9/46*** | (2006.01) |
| ***C22C 38/34*** | (2006.01) |
| ***C21D 6/00*** | (2006.01) |
| ***C22C 38/06*** | (2006.01) |
| ***C22C 38/32*** | (2006.01) |
| ***C21D 8/12*** | (2006.01) |
| ***B21B 3/00*** | (2006.01) |
| ***C22C 38/00*** | (2006.01) |

(52) U.S. Cl.

CPC ..... *C21D 9/46* (2013.01); *B21B 3/00* (2013.01); *C21D 6/002* (2013.01); *C21D 6/008* (2013.01); *C21D 8/1222* (2013.01); *C21D 8/1233* (2013.01); *C22C 38/001* (2013.01); *C22C 38/004* (2013.01); *C22C 38/06* (2013.01); *C22C 38/32* (2013.01); *C22C 38/34* (2013.01); *C22C 2202/02* (2013.01)

(58) Field of Classification Search

None

See application file for complete search history.

(56) References Cited

U.S. PATENT DOCUMENTS

2010/0192895 A1 8/2010 Pelsoeczy

FOREIGN PATENT DOCUMENTS

| | | | | |
|---|---|---|---|---|
| CN | 1784504 | A | | 6/2005 |
| CN | 1665943 | A | | 9/2005 |
| CN | 101441914 | A | | 5/2009 |
| CN | 103060701 | A | | 4/2013 |
| CN | 103276174 | A | | 9/2013 |
| EP | 0601549 | B1 | | 7/1997 |
| EP | 1577413 | A1 | | 9/2005 |
| JP | 38-26263 | | | 12/1966 |
| JP | 45-21181 | | | 7/1970 |
| JP | 56-003625 | A | | 1/1981 |
| JP | S56-016653 | A | | 2/1981 |
| JP | S62-133042 | A | | 6/1987 |
| JP | 62-227078 | A | | 10/1987 |
| JP | 01-299702 | A | | 12/1989 |
| JP | 5-171281 | A | | 7/1993 |
| JP | H06-172940 | A | | 6/1994 |
| JP | 08-302449 | A | | 11/1996 |
| JP | 09-176803 | A | | 7/1997 |
| JP | 11-335794 | A | | 12/1999 |
| JP | 2001-032054 | A | | 2/2001 |
| JP | 2002-194513 | A | | 7/2002 |
| JP | 2002194513 | A | * | 7/2002 |
| JP | 2004-218082 | A | | 8/2004 |
| JP | 2006-219692 | A | | 8/2006 |
| JP | 2010-501044 | A | | 1/2010 |
| KR | 10-0374292 | B1 | | 3/2003 |
| KR | 10-2005-0084478 | A | | 8/2005 |
| WO | 2003/095684 | A1 | | 11/2003 |

OTHER PUBLICATIONS

International Search Report PCT/KR2013/012147 dated Sep. 24, 2014 with full English translation.

U.S. Final Office Action dated Jun. 10, 2019 issued in U.S. Appl. No. 15/107,810.

U.S. Non-final Office Action dated Feb. 8, 2019 issued in U.S. Appl. No. 15/107,810.

U.S. Final Office Action dated Aug. 15, 2018 issued in U.S. Appl. No. 15/107,810.

Japanese Office Action issued in corresponding Japanese Patent Application No. 2016-542773, dated Apr. 10, 2018.

U.S. Non-final Office Action dated Apr. 11, 2018 issued in U.S. Appl. No. 15/107,810.

Japanese Office Action dated Aug. 15, 2017 issued in Japanese Patent Application No. 2016-542773.

* cited by examiner

*Primary Examiner* — Anthony M Liang

(74) *Attorney, Agent, or Firm* — Morgan, Lewis & Bockius LLP

(57) ABSTRACT

The present invention relates to a soft high-silicon steel sheet, and more particularly, to a soft high-silicon steel sheet which has ductility even if the silicon content thereof is greater than 4%, and can thus be manufactured into a steel sheet having a high silicon content only by means of rolling without an additional siliconizing process. The soft high-silicon steel sheet may include a silicon content greater than 4 wt % and less than or equal to 7 wt % and 1 to 20% of chromium, or may include 5 to 7 wt % of Si+Al and 1 to 20 wt % of chromium.

13 Claims, 5 Drawing Sheets

SOFT HIGH-SILICON STEEL SHEET AND MANUFACTURING METHOD THEREOF

CROSS-REFERENCE TO RELATED APPLICATIONS

This application is a divisional of U.S. patent application Ser. No. 15/107,810, filed on Jun. 23, 2016, which is a U.S. National Phase under 35 U.S.C. § 371 of International Patent Application No. PCT/KR2013/012147, filed on Dec. 24, 2013, the subject matter of which are incorporated hereby reference in their entireties.

TECHNICAL FIELD

The present disclosure relates to a soft high-silicon steel sheet, and more particularly, to a soft high-silicon steel sheet able to be manufactured through a rolling process without an additional siliconizing process due to the soft high-silicon steel sheet having ductility even in the case that the silicon content of the soft high-silicon steel sheet is greater than 4%.

BACKGROUND ART

High-silicon steel sheets are commonly used to manufacture the cores of transformers, electric motors, generators, and other electronic devices, and are thus known as "electrical steel sheets." High-silicon steel sheets are typically required to have a high magnetic flux density and a low degree of core loss.

The term "magnetic flux density" refers to the number of magnetic flux lines per unit area. If the magnetic flux density of a core is increased, the same operational conditions may be obtained even in the case that the size of the core is reduced. That is, the size of electrical devices may be reduced by increasing the magnetic flux density of cores of the electrical devices. The term "core loss" refers to energy loss when a core is placed in a magnetic field varying with time. Core loss includes eddy current loss and hysteresis loss. When a magnetic field is induced around a core, eddy current loss may be caused by eddy currents flowing in the core.

Silicon (Si) is an element effective in reducing eddy current loss. Thus, silicon (Si) is added to electrical steel sheets as a key element. Particularly, if the content of silicon in steel sheets is increased to 6.5%, magnetostriction causing noise may almost be absent (in an amount of about 0%), and the permeability of the steel sheets may be maximized. In addition, if the silicon content of steel sheets is high, the core loss of the steel sheets is reduced at high frequencies (for example, 50 Hz or higher, 400 Hz, or 1000 Hz), and the steel sheets may be used efficiently. Therefore, high-silicon steel sheets having the above-described characteristics may be applied to high value electrical devices such as inverters, reactors, the induction heaters of gas turbine generators, or the reactors of uninterruptable power supplies.

When only the above-mentioned characteristics of steel sheets are considered, silicon may be added to steel sheets in amounts as large as possible. However, if the silicon content of steel sheets is increased, the workability of the steel sheets is decreased. In general, if the silicon content of steel sheets is 3.5 wt % or greater, it is very difficult to manufacture such steel sheets using a normal cold rolling process.

To address these problems, Japanese Patent Application Laid-open Publication No. S56-3625 discloses a method of casting molten steel in a rotary die and rapidly cooling the molten steel. In addition, Japanese Patent Application Laid-open Publication No. H5-171281 discloses a method of rolling high-silicon steel clad in low-silicon steel. However, these methods have not yet reached the stage of industrial production.

In addition, Korean Patent No. 10-0374292 discloses a powder metallurgy technique for making high silicon steel powder blocks to be substituted for high silicon steel sheets. According to the disclosed technique, although pure iron powder cores, high silicon steel powder cores, and Sendust powder cores are used in combination, such cores have soft magnetism, inferior to that of high silicon steel sheets, because of the characteristics of powders.

Examples of current mass production techniques using a chemical vapor deposition (CVD) method are disclosed in Japanese Patent Application Publication Nos. S38-26263 and S45-21181 and Japanese Patent Application Laid-open Publication No. S62-227078. According to the disclosed techniques, a steel sheet having a silicon content of about 3% is manufactured and is then annealed using $SiCl_4$ so that silicon (Si) may permeate and diffuse into the steel sheet. According to the disclosed techniques, when a steel sheet is manufactured, the workability of the steel sheet is guaranteed by maintaining the silicon content of the steel sheet at a relatively low level, the silicon content of the steel sheet subsequently being increased by diffusing silicon (Si) into the steel sheet. However, the disclosed techniques use toxic $SiCl_4$, and it takes a significant amount of time to perform such a diffusion annealing process.

In addition, there have been laboratory attempts to manufacture a thin high-silicon steel sheet by performing a warm rolling process, for example, at a temperature of 350° C. or higher instead of performing a cold rolling process after a hot press forming process. Such an attempt is disclosed in Japanese Patent Application Laid-open Publication No. H1-299702. However, the workability of high-silicon steel sheets may be insufficient in a hot press forming process as well as in a cold rolling process. That is, the method of simply increasing a rolling temperature may not sufficiently guarantee the workability of high-silicon steel sheets. That is, after a slab is manufactured through a general continuous casting method, the slab is reheated to a hot rolling temperature. At this time, cracks may be formed in the slab because of a temperature difference between surface and center regions of the slab, and the slab may be broken when being hot rolled after removing the slab from a reheating furnace. FIG. 1 is an image illustrating breakage of a high-silicon steel sheet having a silicon content of 6.5%. The high-silicon steel sheet was broken when the high-silicon steel sheet was hot rolled after heating the high-silicon steel sheet for one and a half hours under an argon atmosphere at a temperature of 1100° C. As illustrated in FIG. 1, a high-silicon steel sheet may be likely to break during a hot press forming process as well as during a cold rolling process. Therefore, it is difficult to adjust the workability of a high-silicon steel sheet by simply adjusting the temperature of a rolling process.

DISCLOSURE

Technical Problem

To address the above-described problems of the related art, an aspect of the present disclosure may provide a soft high-silicon steel sheet able to be manufactured by a method similar to a method of manufacturing electrical steel sheets having a relatively low silicon content, for example, within the range of 4% or less or 3.5% or less.

An aspect of the present disclosure may also provide a soft high-silicon steel sheet having a high magnetic flux density and a low degree of core loss.

The present disclosure is not limited to the above-mentioned aspects. Those having skill in the art to which the present disclosure pertains will easily understand aspects of the present disclosure other than the above-mentioned aspects from the descriptions provided below.

Technical Solution

According to an aspect of the present disclosure, a soft high-silicon steel sheet may include, by wt %, silicon (Si): greater than 4% to 7%, chromium (Cr): 1% to 20%, and boron (B): 0.01% to 0.05%.

The soft high-silicon steel sheet may further include total aluminum (Al) in an amount of 0.1 wt % to 3 wt %, and a content of Si+total Al in the soft high-silicon steel sheet may be within a range of greater than 4.1% to 7%.

According to another aspect of the present disclosure, a soft high-silicon steel sheet may include, by wt %, Si+total Al: 5% to 7%, chromium (Cr): 1% to 20%, boron (B): 0.01% to 0.05%.

The soft high-silicon steel sheet may further include at least one selected from molybdenum (Mo): 0.1% or less, nickel (Ni): 0.01% or less, phosphorus (P): 0.05% or less, and copper (Cu): 0.01% or less. Respective contents of carbon (C) and nitrogen (N) included as impurities in the soft high-silicon steel sheet may be adjusted to 0.05% or less.

According to another aspect of the present disclosure, a method of manufacturing a soft high-silicon steel sheet may include: preparing a steel material including, by wt %, silicon (Si): greater than 4% to 7% and chromium (Cr): 1% to 20%; forming a hot rolled steel sheet by hot rolling the steel material at a temperature of 800° C. or higher; and cold rolling the hot rolled steel sheet within a temperature range of 150° C. to 300° C.

The steel material may further include total aluminum (Al) in an amount of 0.1 wt % to 3 wt %.

Respective contents of carbon (C) and nitrogen (N) included as impurities in the steel material may be adjusted to be 0.05% or less.

The steel material may further include at least one selected from molybdenum (Mo): 0.1% or less, nickel (Ni): 0.01% or less, phosphorus (P): 0.05% or less, and copper (Cu): 0.01% or less.

The steel material may be prepared by a continuous casting method or a strip casting method.

Microstructural grains of the hot rolled steel sheet steel may have a size within a range of 150 μm to 250 μm, and thus the workability of the hot rolled steel sheet may be high.

The forming of the hot rolled steel sheet may include cooling the hot rolled steel sheet from 800° C. to 100° C. at a cooling rate of 30° C./sec or higher after the hot rolling of the steel material, so as to reduce ordered phases existing in the hot rolled steel sheet and thus to further improve the workability of the hot rolled steel sheet.

Alternatively, after the forming of the hot rolled steel sheet, the method may further include heat treating the hot rolled steel sheet within a temperature range of 800° C. to 1200° C. and then cooling the hot rolled steel sheet from 800° C. to 100° C. at a cooling rate of 30° C./sec or higher.

Advantageous Effects

As described above, the present disclosure provides a soft high-silicon steel sheet having a properly adjusted composition so as to be manufactured through manufacturing processes for general electrical steel sheets even in the case that the silicon content of the soft high-silicon steel sheet is greater than 4%.

In addition, according to the present disclosure, the fractions of ordered phases in the soft high-silicon steel sheet are controlled to prevent deteriorations in workability, and the soft high-silicon steel sheet may be manufactured without the need for a process such as a siliconizing process.

BEST MODE

Embodiments of the present disclosure will now be described in detail.

The present disclosure relates to a high-silicon steel sheet having a silicon content greater than 4% by weight (hereinafter, the content of each alloying element is in percentage by weight (wt %) unless otherwise specified). As described above, if the content of silicon (Si) in a steel sheet is greater than 4%, the magnetic flux density and core loss characteristics of the steel sheet may be markedly improved, and the steel sheet may be suitable for applications such as iron cores. However, if the content of silicon (Si) in a steel sheet is excessively high, the workability of the steel sheet is markedly decreased, and thus the upper limit of the silicon content in the steel sheet may be set to be 7%. In the present disclosure, a high-silicon steel sheet refers to a steel sheet having a silicon content within the range of greater than 4% to 7%.

The inventors have examined a high-silicon steel sheet from various aspects to solve the above-described problems and have found that if the composition of a high-silicon steel sheet is properly adjusted, the high-silicon steel sheet can be softened to improve the workability of the high-silicon steel sheet.

There have been some reports about the effects of three alloying elements including nickel (Ni) and manganese (Mn) on steel sheets.

For example, the effects of nickel (Ni) have been reported by C. A. Clark et al. in "Effect of nickel on the properties of grain-oriented silicon-iron alloys," Proceedings of the Institution of Electrical Engineers, Volume 113, Issue 2, February 1966, pages 345 to 351, and the effects of manganese (Mn) have been reported by K. Narita et al. in "Effect of ordering on magnetic properties of 6.5-percent silicon-iron alloy," IEEE Transactions, 1979. However, alloying elements referred to in such documents do not sufficiently improve the cold workability of steel sheets for a cold rolling process. That is, it is still difficult to produce steel sheets through a cold rolling process.

The inventors have found that the addition of chromium (Cr) to a steel sheet in an amount of 1 wt % to 20 wt % is effective in solving the above-described problems, and based on this knowledge, the inventors have invented the present invention. If the content of chromium (Cr) is 1 wt % or greater, it may be effective in solving the above-described problems because of the following reasons. Chromium (Cr) added to a steel sheet may suppress the formation of ordered phases in the steel sheet and may prevent the formation of crack initiation sites in the steel sheet.

Figure 1:
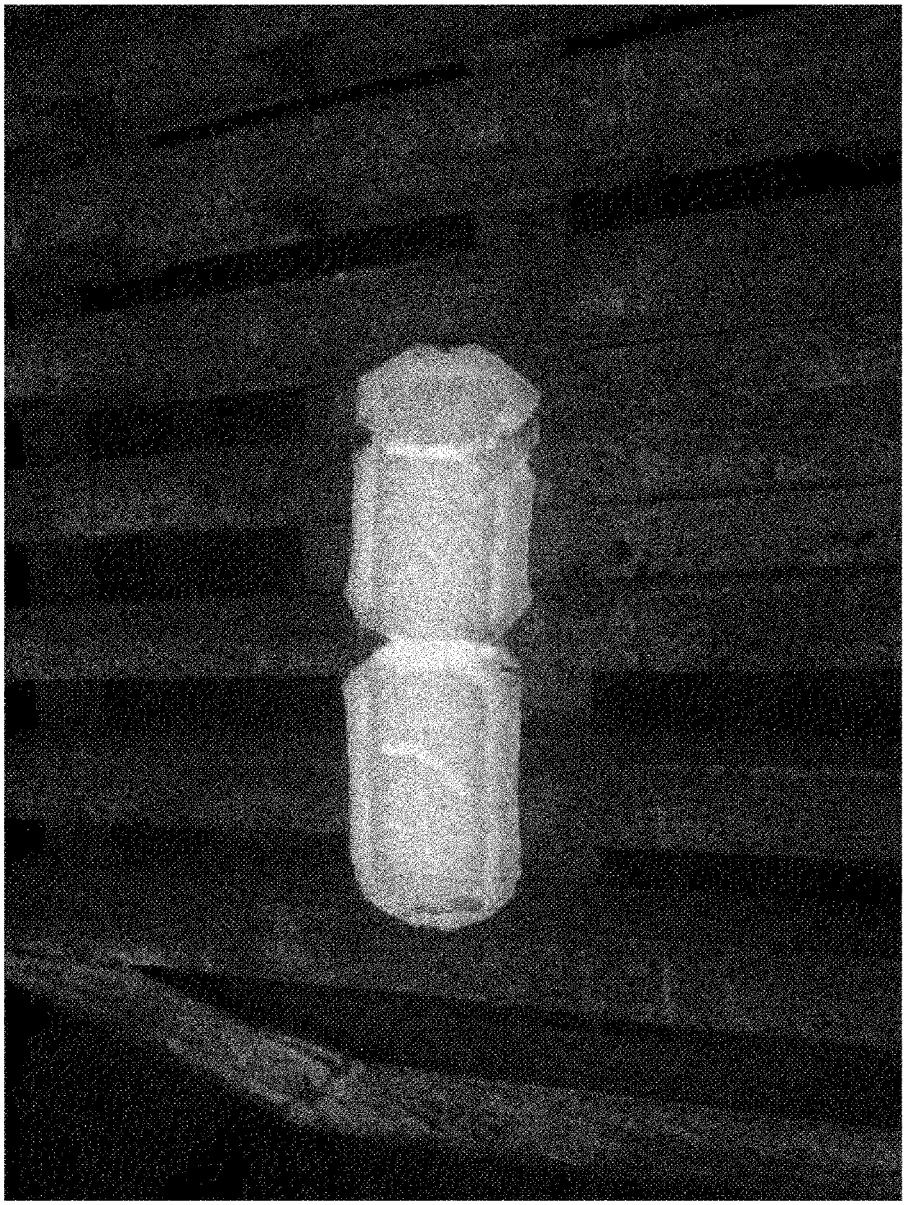
FIG. 1 is an image illustrating a high-silicon steel sheet broken during a hot press forming process.
Figure 2:
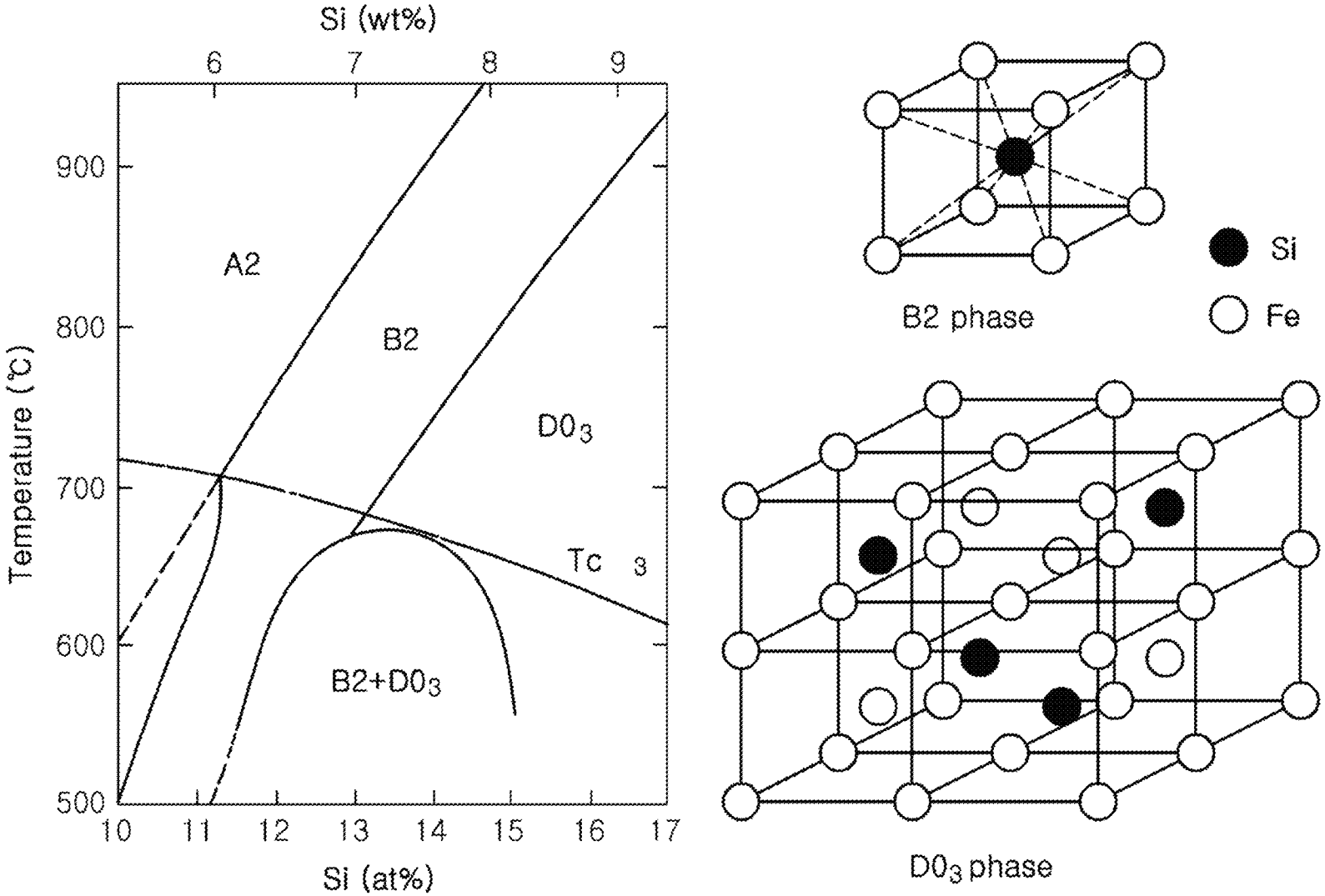
FIG. 2 is an Fe—Si binary phase diagram illustrating the formation of ordered phases increasing the brittleness of a high-silicon steel sheet.

That is, referring to a phase diagram of FIG. 2, a B2 ordered phase and a $DO_3$ ordered phase are formed in a steel sheet having a silicon content greater than 4% as proposed in the present disclosure, and the ordered phases increase the brittleness of the steel sheet while worsening the workability of the steel sheet. When compared to disordered phases (for example, an A2 disordered phase in FIG. 2), ordered phases are considered to increase the brittleness of steel sheets for at least one of the following reasons.

1) It is difficult for dislocations moving in ordered lattices to undergo cross slip, thereby facilitating stress concentration or grain boundary fracturing. 2) Ordered alloys have unusual structures, and thus, the energy of cracks propagating along grain boundaries is lower than the energy of cracks propagating inside grains. As a result, grain boundary fracturing may occur easily in ordered alloys. Therefore, if the formation of ordered phases is suppressed in a high-silicon steel sheet, the brittleness of the high-silicon steel sheet may be reduced. To this end, chromium (Cr) may be added to a high-silicon steel sheet in an amount of 1 wt % or greater. If chromium (Cr) is added to a steel sheet in an amount of 1 wt % or greater, the fraction of an A2 disordered phase may increase at room temperature, and thus the brittleness of the steel sheet may be decreased. Since ordered phases obstruct the movement of magnetic domains as well as the movement of dislocations, the addition of chromium (Cr) may also improve magnetic characteristics.

Figure 3:
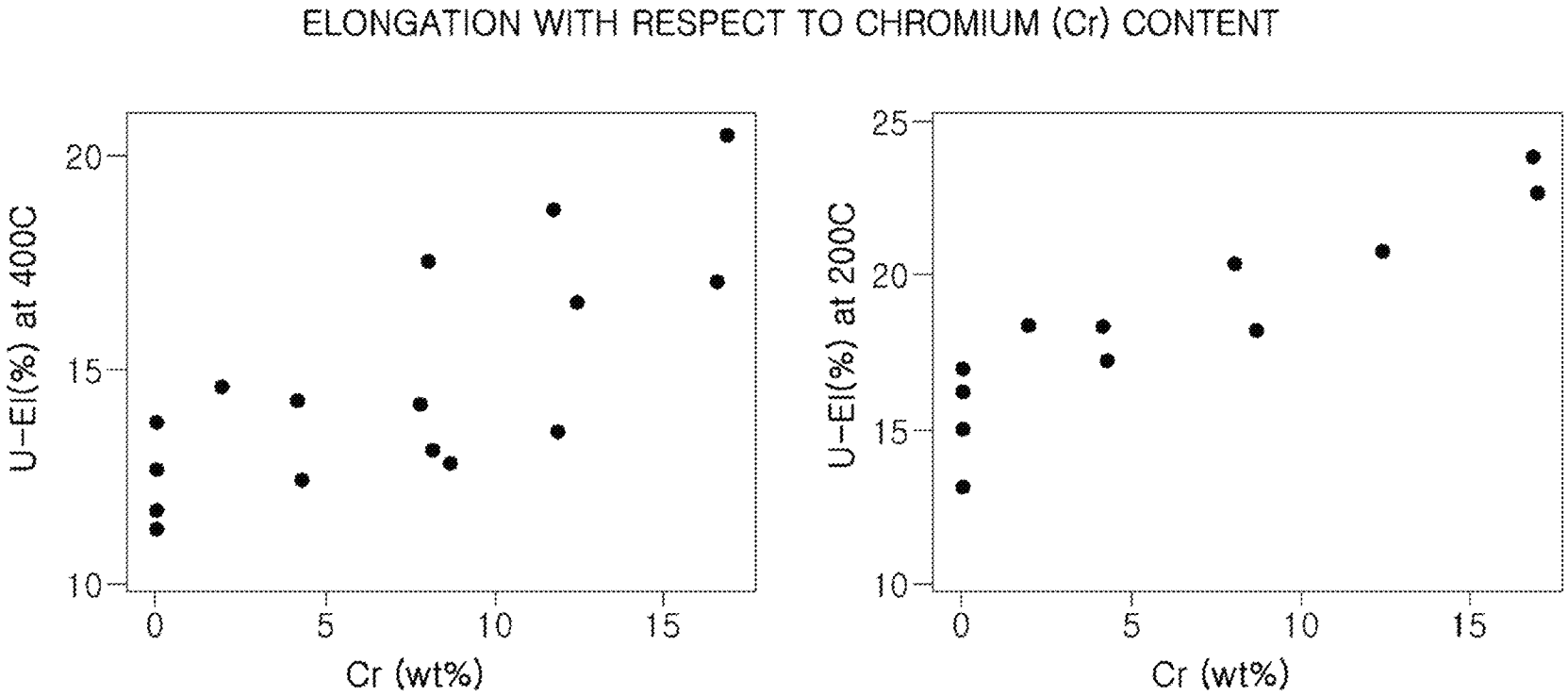
FIG. 3 is a graph illustrating the uniform elongation of a 5% Si-1% Al steel sheet at 400° C. and 200° C. with reference to the content of chromium (Cr), the left box illustrating uniform elongation at 400° C., the right box illustrating uniform elongation at 200° C.

However, the addition of chromium (Cr) markedly increases the uniform elongation of a steel sheet. FIG. 3 illustrates the uniform elongation of a steel sheet having 5% silicon (Si) and 1% aluminum (Al) with respect to the content of chromium (Cr). As illustrated in FIG. 3, when the content of chromium (Cr) is 0%, the uniform elongation U-El is 10% to 15% at 400° C., and about 10% at 200° C. However, if the content of chromium (Cr) increases, the uniform elongation U-El also increases at both temperatures.

Figure 4:
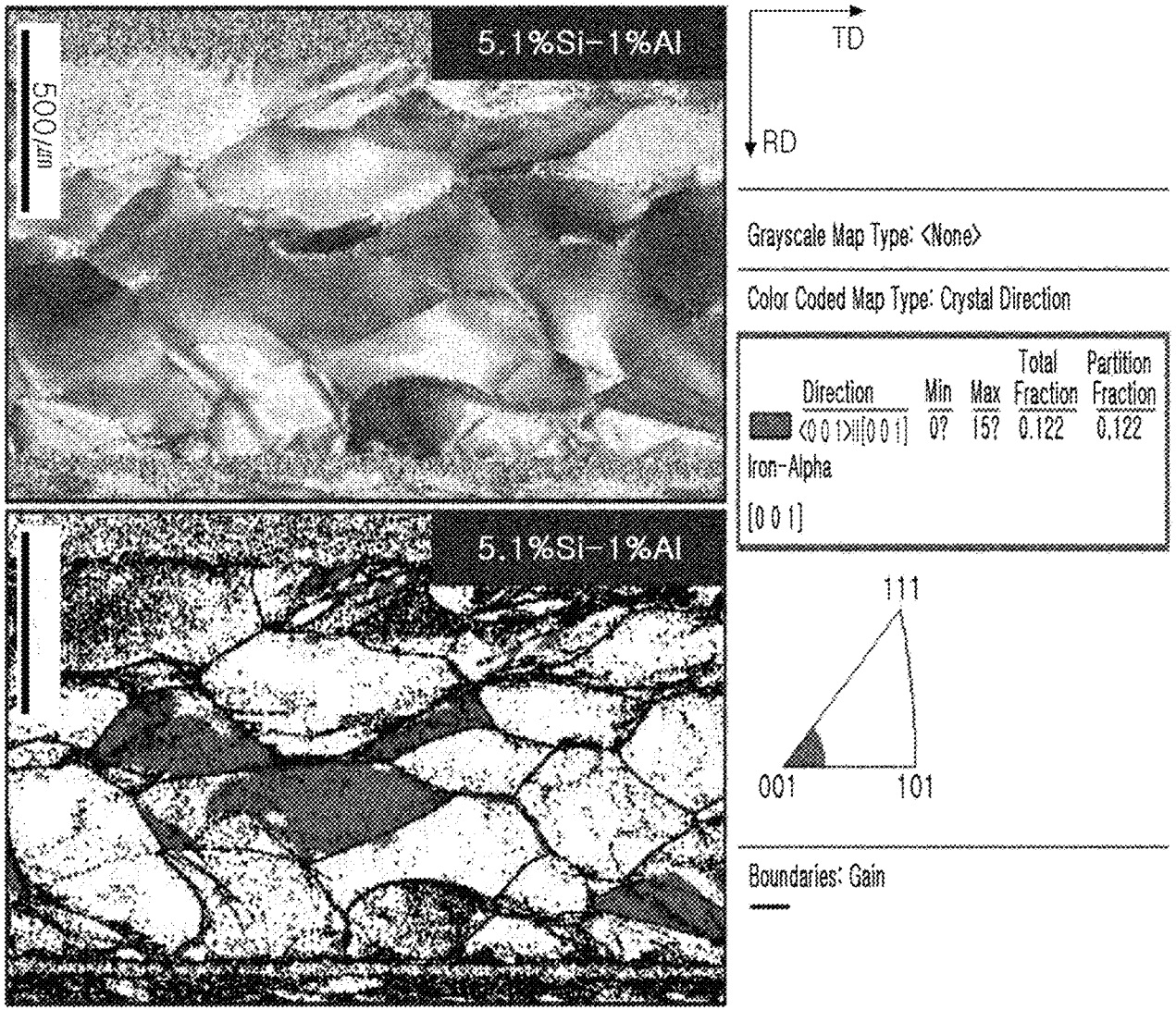
FIG. 4 illustrates the grain size and texture of a chromium-free high-silicon steel sheet after a hot rolling process.
Figure 5:
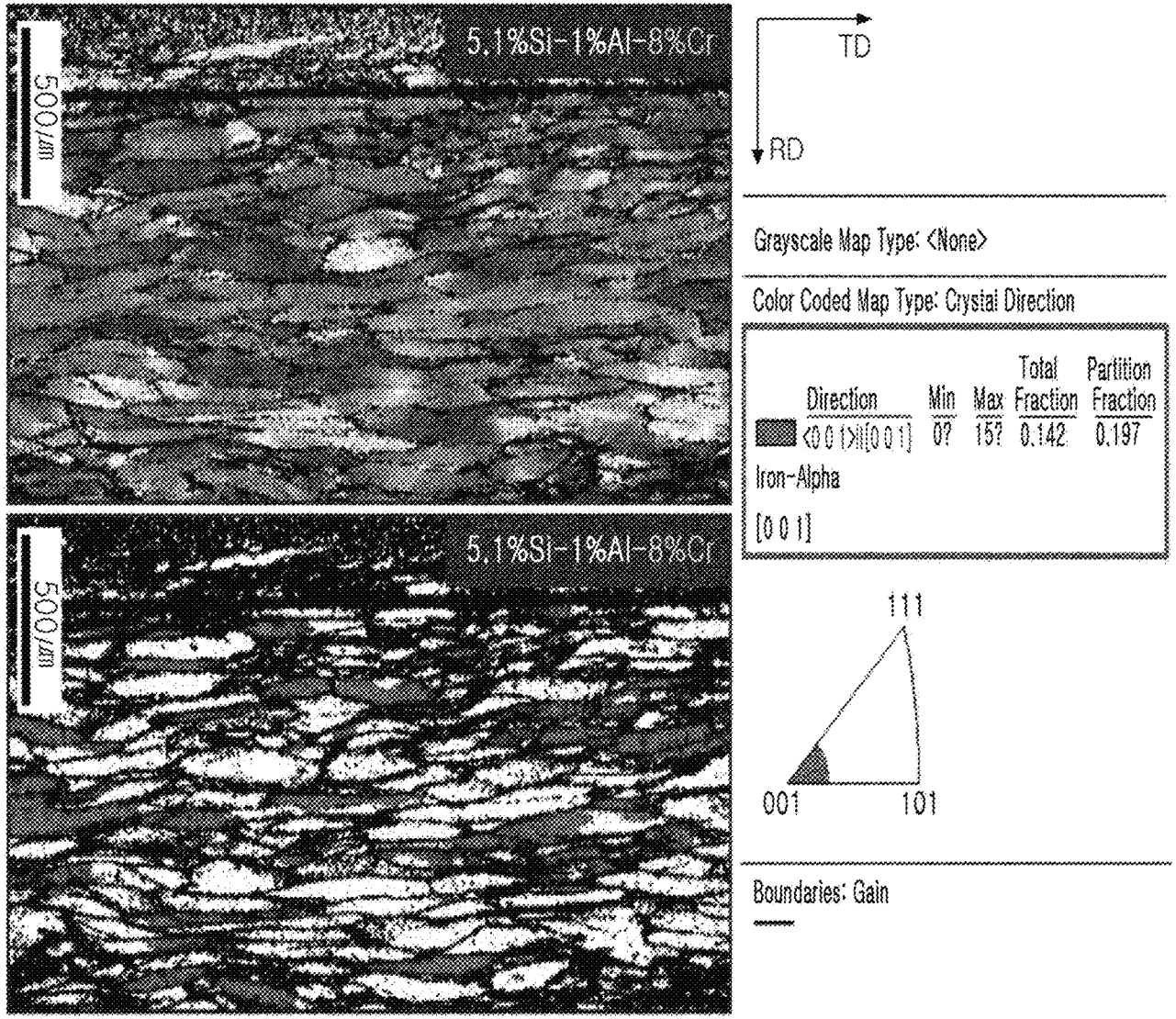
FIG. 5 illustrates the grain size and texture of a high-silicon steel sheet including chromium (Cr) after a hot rolling process.

In addition, chromium (Cr) added to a high-silicon steel sheet has an effect of reducing the grain size of the high-silicon steel sheet after a hot rolling process, thereby improving the hot rollability and cold rollability (or warm rollability) of the high-silicon steel sheet. FIG. 4 illustrates the microstructure of a high-silicon steel sheet including 5.1% silicon (Si), 1% aluminum (Al), and chromium (Cr) after a hot press forming process was performed on the high-silicon steel sheet (the hot rolling process was finished at 1100° C., and the thickness of the high-silicon steel sheet was 2.5 mm after the hot press forming process). FIG. 5 illustrates the microstructure of a high-silicon steel sheet after a hot rolling process was performed on the high-silicon steel sheet. The high-silicon steel sheet of FIG. 5 had the same silicon and aluminum contents as the high-silicon steel sheet of FIG. 4 and additionally had a chromium content of 8%. Slab thicknesses, hot rolling temperatures, and final steel sheet thicknesses were equal in the two cases shown in FIGS. 4 and 5. As illustrated in FIGS. 4 and 5, the grains of the steel sheet of FIG. 5 including chromium (Cr) were smaller than the grains of the steel sheet of FIG. 4 not including chromium (Cr). That is, in the present disclosure, the addition of chromium (Cr) to a high-silicon steel sheet in an amount of 1% or greater is proposed to guarantee the workability of the high-silicon steel sheet.

In addition, when a slab formed by casting is reheated before a hot rolling process, a low melting point oxide, fayalite ($Fe_2SiO_4$), is formed, and such oxides may form crack initiation sites by eroding the surface and sides of the slab. However, if the content of chromium (Cr) is adjusted to be within the range proposed in the present disclosure, the formation of fayalite is suppressed, and thus the number of crack initiation sites may be markedly reduced. Therefore, a high-silicon steel sheet, for example, having a thickness of 1 mm to 3 mm, may be manufactured through a hot rolling process without cracking or breakage unlike the case of a high-silicon steel sheet not including chromium (Cr). In addition, if a hot rolling mill connected to a strip caster is used, a thin high-silicon steel sheet having a thickness up to 0.1 mm may be manufactured at a high production rate.

In addition, the magnetic characteristics of a high-silicon steel sheet may be improved in proportion to the amount of a {100}<001> texture (known as a cube texture) in the high-silicon steel sheet, and the addition of chromium (Cr) may increase the fraction of the cube texture.

However, if the content of chromium (Cr) in a high-silicon steel sheet is excessively high, many edge cracks may be formed during a hot rolling process. That is, the rollability of the high-silicon steel sheet may decrease. Thus, it may be preferable that the content of chromium (Cr) be adjusted to be within the range of 20% or less, and more preferably within the range of 16% or less.

In addition, so as to further improve the rollability of a high-silicon steel sheet, boron (B) may preferably be added in an amount of 0.01% to 0.05% and more preferably in an amount of 0.01% to 0.03%. In this case, when a cold rolling process is performed at a relatively low temperature, the workability of the high-silicon steel sheet may be more reliably guaranteed to a degree allowing for commercial production. That is, when boron (B) is added to guarantee rollability, if the content of boron (B) is properly adjusted, intended effects may be more effectively obtained. When the contents of silicon (Si) and chromium (Cr) are adjusted as proposed in the present disclosure, it may be preferable that the content of boron (B) be adjusted to be within the range of 0.01% to 0.05% and more preferably within the range of 0.01% to 0.03%. This is applied in the same manner when the content of Si+Al is properly adjusted as described below.

Therefore, according to an aspect of the present disclosure, a soft high-silicon steel sheet may include, by wt %, silicon (Si): greater than 4% to 7%, chromium (Cr): 1% to 20%, and boron (B): 0.01% to 0.05%.

According to another aspect of the present disclosure, the soft high-silicon steel sheet may further include aluminum (total aluminum) in an amount of 0.1% to 3%. If the content of total aluminum is 0.1% or greater, the rollability of the soft high-silicon steel sheet may be effectively improved. However, if aluminum is excessively added, the rollability of the soft high-silicon steel sheet may adversely decrease. Thus, it may be preferable that the content of total aluminum be within the range of 3% or less.

In addition, if aluminum (Al) and silicon (Si) are both added to the soft high-silicon steel sheet, since silicon-induced improvements in magnetic properties such as an increase in magnetic flux density or a decrease in core loss are also obtainable by aluminum (Al), the content of silicon (Si) may be reduced according to the content of aluminum (Al). Due to this reason, according to an aspect of the present disclosure, it may be preferable that the content of (Si+total Al) be within the range of 4% or greater, and within the range of greater than 4.1% according to another aspect, and within the range of 5% or greater according to another aspect. However, if the content of (Si+total Al) is greater than 7%, the rollability of the soft high-silicon steel sheet may decrease. Thus, the upper limit of the content of (Si+total Al) may be set to be 7%.

The above-described effects may be more surely obtained when the content of chromium (Cr) is preferably within the range of 1% to 20%, and more preferably within the range of 1% to 16%. Therefore, according to another aspect of the present disclosure, the content of silicon (Si) and aluminum (Al) (Si+total Al) in the soft high-silicon steel sheet may be adjusted to be within the range of 5% to 7%, and chromium (Cr) and boron (B) may be added to the soft high-silicon steel sheet in an amount of 1% to 20% (Cr) and in an amount of 0.01% to 0.05% (B).

In addition, for improvements in magnetic characteristics, the soft high-silicon steel sheet may further include at least one selected from molybdenum (Mo): 0.1% or less, nickel (Ni): 0.01% or less, phosphorus (P): 0.05% or less, and copper (Cu): 0.01% or less. If the soft high-silicon steel sheet includes at least one of the listed elements, the magnetic characteristics or brittleness of the soft high-silicon steel sheet may be improved. Particularly, although electrical high-silicon steel sheets may undergo hydrogen embrittlement, if molybdenum (Mo) is added in an amount of 0.1% or less to such electrical high-silicon steel sheets, hydrogen embrittlement may be effectively suppressed.

In the present disclosure, the other components of the soft high-silicon steel sheet are iron (Fe) and impurities inevitably added during manufacturing processes. In addition, other alloying elements for steel sheets used for core materials may also be added to the soft high-silicon steel sheet of the present disclosure unless the addition of such alloying elements has an effect not intended in the present disclosure.

Non-limiting examples of impurities that may be included in the soft high-silicon steel sheet of the present disclosure may be carbon (C) (0.05% or less) and nitrogen (N) (0.05% or less). If the contents of such impurities increase, the brittleness of the soft high-silicon steel sheet may deteriorate, and thus the rollability of the soft high-silicon steel sheet may deteriorate. Thus, preferably, the contents of such impurities may only be allowed up to 0.05%, respectively.

According to the present disclosure, the area fraction of the cube texture in the soft high-silicon steel sheet may be about 13% to about 25%. This may be attained by the addition of silicon (Si) and chromium (Cr) in large amounts. Thus, the soft high-silicon steel sheet of the present disclosure may have improved magnetic characteristics as compared to steel sheets of the related art having a cube texture fraction of 12% or less.

The soft high-silicon steel sheet of the present disclosure may be manufactured through processes including a hot rolling process and a cold rolling process or processes including a hot rolling process and a low-temperature warm rolling process. In this case, specific conditions of the processes are not particularly limited. That is, those of ordinary skill in the art to which the present disclosure pertains may easily select or adjust process conditions to manufacture the soft high-silicon steel sheet of the present disclosure based on the above-described characteristics of the soft high-silicon steel sheet.

For example, the following process condition is proposed by the inventors.

Slab Hot Rolling Temperature: 800° C. or Higher

A hot rolling process has an effect of primarily adjusting the thickness of a steel sheet and refining the microstructure of a steel sheet, thereby making it easy to perform a subsequent cold rolling process or a warm rolling process. Preferably, a slab may be hot rolled at a temperature of 800° C. or higher. If the hot rolling temperature is lower than 800° C., ordered phases may be easily formed. That is, if the hot rolling process is performed at a temperature lower than 800° C., the brittleness of a steel sheet may increase, and thus the steel sheet may be fractured. The upper limit of the hot rolling temperature is not particularly set if the hot rolling temperature is within a range in which high-silicon steel sheets are generally hot rolled. In a non-limiting example, the hot rolling temperature may be set to be 1200° C. or lower so as to uniformly heat a slab and control the surface quality of the slab.

Before a slab produced by casting is cooled, the hot rolling process may be immediately performed without a slab reheating process. Alternatively, the hot rolling process may be performed after reheating a cooled slab. However, to prevent the formation of fayalite during a reheating process, the hot rolling process may be immediately performed on a slab not cooled after casting. In the case of reheating a slab, it may be preferable that the slab be reheated before the surface temperature of the slab decreases to a temperature lower than 700° C. However, this is a non-limiting example. In an exemplary embodiment, instead of manufacturing a slab by casting, a thin steel sheet may be directly manufactured through a strip casting process which may then be directly subjected to a hot rolling process. According to a strip casting technique, molten steel may be supplied to a region between a pair of rotating rolls (a twin roll method) or to a single rotating roll (a single roll method), so as to cast the molten steel as a thin steel sheet (other methods such as a single belt method also exist). Those of ordinary skill in the related art to which the present disclosure pertains may easily use the strip casting technique. Even in this case, it may be preferable that the hot rolling temperature be set to be 800° C. or higher.

In addition, the thickness of the steel sheet (hot rolled steel sheet) obtained through the hot rolling process may preferably be 3 mm or less. If the thickness of the hot rolled steel sheet is excessively large, the reduction ratio of a subsequent cold rolling process or a warm rolling process may become excessively high, and thus the steel sheet may break. Although the hot rolled steel sheet is thin, problems may not occur. Thus, the lower limit of the thickness of the hot rolled steel sheet may not be set. However, if the hot rolled steel sheet is excessively thin, a large load may be applied to the steel sheet during the hot rolling process, and thus breakage or cracking may occur. In this regard, the thickness of the hot rolled steel sheet may be set to be, but is not limited to, 2 mm or less. Particularly, when a steel sheet is manufactured through a strip casting process, the lower limit of the steel sheet may be reduced to 1.0 mm. However, if hot rolling techniques are improved, the lower limit of the thickness of the hot rolled steel sheet may be further reduced. Thus, the thickness of the hot rolled steel sheet is not limited to the above-mentioned range.

The hot rolled steel sheet manufactured as described above may have a grain size within the range of 150 μm to 250 μm, and thus the hot rolled steel sheet may have a high degree of workability when compared to hot rolled steel sheets of the related art. Therefore, the workability of the hot rolled steel sheet in a subsequent cold rolling process may be high. When it is considered that high-silicon steel sheets of the related art have a grain size within the range of 500 μm or greater, it can be clearly understood that the hot rolled steel sheet of the present disclosure has a very small grain size.

Cold Rolling: 150° C. to 300° C.

According to the present disclosure, the workability of the hot rolled steel sheet having the above-described composition is improved compared to that of steel sheets of the related art. Thus, a cold rolling process may be performed on the hot rolled steel sheet within a cold rolling temperature range of 300° C. or lower and preferably within a cold rolling temperature range of 250° C. or lower. However, if the cold rolling temperature is excessively low, the steel sheet may break. Thus, the lower limit of the cold rolling temperature may be set to be 150° C.

The cold rolling process may be controlled such that after the cold rolling process is performed, the steel sheet may have a thickness within the range of 0.1 mm to 0.5 mm according to characteristics of a final product.

Therefore, according to an embodiment of the present disclosure, a method of manufacturing a soft high-silicon steel sheet may include: preparing a slab having the above-described composition; hot rolling the slab at a temperature of 800° C. or higher to obtain a hot rolled steel sheet; and cold rolling the hot rolled steel sheet to obtain a steel sheet having a final thickness.

Although the cold rolling process may be performed directly after the hot rolling process, a heat treatment process may be performed prior to the cold rolling process so as to develop a crystal texture effective in imparting intended magnetic characteristics to the hot rolled steel sheet and further improve the workability of the hot rolled steel sheet by controlling the grain size of the hot rolled steel sheet and reducing the fractions of ordered phases in the hot rolled steel sheet. Therefore, according to an aspect of the present disclosure, a heat treatment process may be performed between the hot rolling process and the cold rolling process.

Heat Treatment Temperature: 800° C. to 1200° C.

Since ordered phases are formed in large amounts in the hot rolled steel sheet, if the hot rolled steel sheet is directly subjected to the cold rolling process or a warm rolling process, problems such as breakages may occur because the rollability of the hot rolled steel sheet is low. Therefore, according to an exemplary embodiment of the present disclosure, a heat treatment process may be performed on the hot rolled steel sheet at a temperature of 800° C. or higher before the cold rolling process or a warm rolling process. If the heat treatment process is performed at a temperature of 800° C. or higher, ordered phases existing in the hot rolled steel sheet may be removed by phase transformation. However, if the temperature of the heat treatment process is excessively high, high energy costs may be incurred, and a large amount of scale may be formed on the surface of the hot rolled steel sheet. Therefore, the upper limit of the temperature of the heat treatment process may be set to be 1200° C. Preferably, the temperature of the heat treatment process may be within the range of 900° C. to 1200° C.

Heat Treatment Atmosphere

If scale is formed on the steel sheet during the heat treatment process, the rollability of the steel sheet may decrease. Thus, the heat treatment process may be performed under a non-oxidative atmosphere. To this end, an inert gas such as nitrogen gas, argon gas, or a mixture of nitrogen gas and argon gas, or a reducing gas including such an inert gas and hydrogen gas in a volume fraction of less than 35% may be used as a process gas in the heat treatment process.

Cooling after Heat Treatment: cooling temperature range including the range of 800° C. to 100° C. with a cooling rate of 30° C./sec or higher.

Although ordered phases are removed from the steel sheet heated to the above-mentioned high temperature, if the steel sheet is slowly cooled, ordered phases may be formed again in the steel sheet. Thus, the steel sheet may be cooled at a cooling rate of 30° C./sec or higher so as to prevent the formation of ordered phases in the steel sheet. As the cooling rate increases, the above-mentioned effect may be reliably obtained. Thus, the upper limit of the cooling rate may not be set. For example, the steel sheet may be quenched. However, if the cooling of the steel sheet starts from a temperature lower than 800° C. or ends at a temperature higher than 100° C., ordered phases may be formed in the steel sheet in large amounts. Thus, the cooling temperature range of the steel sheet may include a temperature range of 800° C. to 100° C. Although these cooling conditions are for improving the workability (rollability) of the steel sheet, these cooling conditions may not be applied to the steel sheet within all alloying element content ranges proposed in the present disclosure. That is, since the workability of the steel sheet is markedly improved by the addition of chromium (Cr), although the steel sheet is cooled at a relatively low cooling rate as in the case of air cooling, the steel sheet may be adequately rolled in a subsequent cold rolling process.

As described above, the heat treatment process and the cooling process are performed to remove ordered phases or suppress the formation of ordered phases before a cold rolling process or a warm rolling process. If the heat treatment process is not performed after the hot rolling process, the cooling process may instead be performed from a temperature of 800° C. or higher to a temperature of 100° C. or lower at a high cooling rate, within the range of 30° C./sec or higher. As described above, the upper limit of the cooling rate is not particularly set. However, if the heat treatment process is performed, the texture of the steel sheet may be more effectively controlled.

After the steel sheet is cold or warm rolled, a final annealing process may be performed on the steel sheet according to a general annealing method. The final annealing process may be performed within a temperature range of 900° C. to 1200° C. That is, the final annealing process may preferably be performed at a temperature of 900° C. or higher, so as to increase the fraction of cube texture in the steel sheet. However, if the temperature of the finally annealing process is higher than 1200° C., the above-mentioned effect is not further obtained, and energy costs increase. Thus, the upper limit of the temperature of the final annealing process may be set to be 1200° C.

Other manufacturing conditions not described in the present disclosure may be adjusted or selected according to general manufacturing conditions, and the manufacturing method may further include manufacturing processes generally used in the related art.

MODE FOR INVENTION

Hereinafter, embodiments of the present disclosure will be described more specifically according to examples. However, the following examples should be considered in a descriptive sense only and not for purpose of limitation. The scope of the present invention is defined by the appended claims, and modifications and variations reasonably made therefrom.

EXAMPLES

Example 1

Slabs for manufacturing electric steel sheets having the compositions illustrated in Table 1 were prepared. Although not illustrated in Table 1, the contents of carbon (C) and nitrogen (N), main components included as impurities in the slabs, were adjusted to be about 0.005% and about 0.0033%, respectively. The prepared slabs were heated to 1100° C. for 1 hour, and a hot rolling process was performed on the slabs. The hot rolling process started at 1050° C. and ended at 850° C. Hot rolled steel sheets having a thickness of 2.5 mm were formed from the slabs having a thickness of 30 mm through the hot press forming process. A heat treatment process was performed on the hot rolled steel sheets (hot rolled silicon steel sheets) at 1000° C. for 5 minutes under an atmosphere including 20 volume % hydrogen and 80 volume % nitrogen, and then the hot rolled silicon steel sheets were air cooled to room temperature. In this manner, hot rolled steel sheets were obtained. Thereafter, the hot rolled steel sheets were pickled to remove surface oxide layers. Thereafter, a cold (warm) rolling process was performed on the hot rolled steel sheets at 400° C. and 150° C. to obtain steel sheets having a final thickness of 0.2 mm.

The rollability of the steel sheets was evaluated according to conditions as illustrated in Table 1. In table 1, i) a steel sheet not rolled to a final thickness due to breakage is denoted as "broken," ii) a steel sheet rolled to a final thickness but cracked to a length of 1 cm or longer is denoted as "defective," iii) a steel sheet slightly cracked to a length shorter than 1 cm is denoted as "normal," and iv) a steel sheet in which no crack was observed is denoted as "good."

TABLE 1

| | Composition (wt %) | | | | Mechanical properties | |
|---|---|---|---|---|---|---|
| | Si | Al | Cr | B | Rollability [400° C.] | Rollability [150° C.] |
| *CS 1 | 3.8 | 0.1 | 1.2 | 0.011 | Good | Good |
| CS 2 | 7.2 | 0.1 | 1.3 | 0.012 | Broken | Broken |
| CS 3 | 5 | 0.9 | 0.8 | 0.011 | Defective | Broken |
| CS 4 | 5.1 | 0.9 | 21.2 | 0.013 | Defective | Broken |
| CS 5 | 4.1 | 3.3 | 1.1 | 0.011 | Broken | Broken |
| CS 6 | 4.5 | 2 | 1.2 | 0.008 | Normal | Defective |
| CS 7 | 4.5 | 1.9 | 1.2 | 0.052 | Defective | Broken |
| **IS 1 | 5.1 | 0.001 | 1.1 | 0.011 | Good | Normal |
| IS 2 | 5.2 | 0.003 | 19.7 | 0.012 | Good | Good |
| IS 3 | 4 | 2.9 | 1.1 | 0.013 | Good | Good |
| IS 4 | 4.5 | 1.9 | 1.1 | 0.011 | Good | Normal |
| IS 5 | 4.5 | 2.1 | 1.2 | 0.048 | Good | Good |
| IS 6 | 5 | 0.9 | 1.2 | 0.014 | Good | Good |
| IS 7 | 5.2 | 1 | 19.8 | 0.011 | Good | Good |

*CS: Comparative Sample,
**IS: Inventive Sample

Referring to Table 1, since silicon (Si) was excessively added to Comparative Sample 2, Comparative Sample 2 was broken when rolled at 400° C. and 150° C. although the contents of chromium (Cr) and boron (B) in Comparative Sample 2 were higher than proposed lower limits. In addition, the content of chromium (Cr) in Comparative Sample 3 was lower than the range proposed in the present disclosure, and thus the formation of ordered phases in Comparative Sample 3 was not sufficiently prevented. Thus, the rollability of Comparative Sample 3 was poor. Comparative Sample 4 had an excessively high content of chromium (Cr), and thus the rollability of Comparative Sample 4 was poor. The content of aluminum (Al) in Comparative Sample 5 was higher than the range proposed in the present disclosure, and thus Comparative Sample 5 was broken. The rollability of Comparative Sample 6 having an insufficient content of boron (B) was normal at 400° C. but poor at 150° C. This shows that boron (B) is an element guaranteeing rollability. However, when the content of boron (B) was excessively high (Comparative Sample 7), rollability was poor even at 400° C.

However, the rollability of inventive samples satisfying the conditions proposed in the present disclosure was good at a rolling temperature of 400° C. and was good or normal at a cold rolling temperature of 150° C. proposed as a low cold rolling temperature in the present disclosure (the size of cracks was about 0.2 cm or less). Aluminum (Al) was not substantially added to Inventive Samples 1 and 2.

Example 2

Steel sheets successfully rolled to a final thickness of 0.2 mm in the same manner as in Example 1 were annealed at 1000° C. for 10 minutes under a dry atmosphere including 20 volume % hydrogen and 80 volume % nitrogen and having a dew point of −10° C., so as to confer final magnetic characteristics on the steel sheets. Then, magnetic characteristics of the steel sheets were measured as illustrated in Table 2. In addition, the fraction of <100>{001} texture (known as a cube texture) of each hot rolled steel sheet was measured using an electron backscatter diffraction (EBSD) detector of a scanning electron microscope (SEM), and results of the measurement are compared in Table 2. The fraction of the cube texture in hot rolled steel sheets has a significant effect on magnetic characteristics of the hot rolled steel sheets. As the fraction of <100>{001} texture in hot rolled steel sheets increases, magnetic characteristics of the hot rolled steel sheets may be improved.

TABLE 2

| | Composition (wt %) | | | | Magnetic properties | | Volume fraction of <100> {001} texture in hot rolled steel sheet [%] |
|---|---|---|---|---|---|---|---|
| | Si | Al | Cr | B | W10/400 [W/kg] | W10/1000 [W/kg] | |
| *CS 8 | 3.8 | 0.02 | 1.2 | 0.011 | 14.3 | 65 | 11.3 |
| **IS 8 | 4.1 | 0.9 | 4.1 | 0.012 | 6.5 | 23.2 | 15.7 |
| IS 9 | 5.1 | 1 | 8.2 | 0.011 | 5.86 | 21.4 | 19.7 |
| IS 10 | 6.7 | 0.01 | 16.3 | 0.013 | 5.65 | 19.7 | 20.1 |

*CS: Comparative Sample,
**IS: Inventive Sample

As described above, Comparative Sample 8 having a low silicon content had relatively high core loss when compared to inventive samples. As the core loss increases, energy loss increases. That is, Comparative Sample 8 is not suitable as an electrical steel sheet. However, each of the inventive samples satisfying the composition proposed in the present disclosure had a low degree of core loss. Particularly, the inventive samples satisfying the conditions proposed in the present disclosure had a low degree of core loss even at a high frequency (1000 Hz). That is, the inventive samples are suitable for manufacturing high-frequency cores.

Example 3

A silicon steel alloy including, by wt %, silicon (Si): 5%, aluminum (Al): 1%, chromium (Cr): 12%, carbon (C): 0.002%, and nitrogen (N): 0.003% was cast to obtain strips having a thickness of 2.0 mm by using a vertical twin roll strip caster. The strips having a thickness of 2.0 mm was hot rolled using a hot rolling mill connected to the vertical twin roll caster, so as to obtain hot rolled high-silicon steel sheets. The hot rolling process started at 1000° C. and ended at 850° C. The hot rolled high-silicon steel sheets were heated for 5 minutes at 1000° C. under an atmosphere including 20 volume % hydrogen and 80 volume % nitrogen and were then cooled. The cooling of the hot rolled high-silicon steel sheets was performed at two cooling rates: 100° C./sec and 10° C./sec, from 800° C. to 100° C., and then the hot rolled high-silicon steel sheets were pickled with a hydrochloric acid solution so as to remove surface scale, and then the steel sheets were warm rolled at 150° C. Regardless the cooling rates, the steel sheets could be rolled to a thickness of 0.1 mm. However, when the cooling rate of the steel sheets was 100° C./sec, the rollability of the steel sheets was relatively high. The addition of chromium (Cr) suppressed the formation of ordered phases and thus fundamentally improved the rollability of the steel sheets, and the formation of ordered phases was effectively suppressed during the cooling process. Thus, the above-mentioned results could be obtained.

The invention claimed is:

1. A method of manufacturing a high-silicon steel sheet, the method comprising:

preparing a steel material comprising, by wt %, silicon (Si): greater than 4% to 7% and chromium (Cr): 1% to 20%;

forming a hot rolled steel sheet by hot rolling the steel material at a temperature of 800° C. or higher; and cold rolling the hot rolled steel sheet within a temperature range of 150° C. to 300° C., and wherein the forming of the hot rolled steel sheet comprises cooling the hot rolled steel sheet from 800° C. to 100° C., at a cooling rate of 30° C./sec or higher after the hot rolling of the steel material.

2. The method of claim 1, wherein the steel material further comprises aluminum (Al) in an amount of 0.1 wt % to 3 wt %.

3. The method of claim 2, wherein a content of Si+Al in the steel material is within a range of greater than 4.1% to 7%.

4. The method of claim 1, wherein respective contents of carbon (C) and nitrogen (N) in the steel material is adjusted to be 0.05% or less.

5. The method of claim 2, wherein respective contents of carbon (C) and nitrogen (N) in the steel material is adjusted to be 0.05% or less.

6. The method of claim 3, wherein respective contents of carbon (C) and nitrogen (N) in the steel material is adjusted to be 0.05% or less.

7. The method of claim 1, wherein the steel material further comprises at least one selected from molybdenum (Mo): 0.1% or less, nickel (Ni): 0.01% or less, phosphorus (P): 0.05% or less, and copper (Cu): 0.01% or less.

8. The method of claim 2, wherein the steel material further comprises at least one selected from molybdenum (Mo): 0.1% or less, nickel (Ni): 0.01% or less, phosphorus (P); 0.05% or less, and copper (Cu): 0.01% or less.

9. The method of claim 3, wherein the steel material further comprises at least one selected from molybdenum (Mo): 0.1% or less, nickel (Ni): 0.01% or less, phosphorus (P): 0.05% or less, and copper (Cu): 0.01% or less.

10. The method of claim 1, wherein the steel material is prepared by a continuous casting method or a strip casting method.

11. The method of claim 1, wherein microstructural grains of the hot rolled steel sheet steel have a size within a range of 150 μm to 250 μm.

12. The method of claim 1, wherein after the forming of the hot rolled steel sheet, the method further comprises heat treating the hot rolled steel sheet within a temperature range of 800° C. to 1200° C. and then cooling the hot rolled steel sheet from 8000° C. to 100° C. at a cooling rate of 30° C./sec or higher.

13. The method of claim 1, wherein the high-silicon steel sheet has the cube texture of 13% to 25% by area fraction.

* * * * *